US008911274B1

(12) United States Patent
Campana

(10) Patent No.: US 8,911,274 B1
(45) Date of Patent: Dec. 16, 2014

(54) FLYING AERODYNAMIC TOY WITH PERIPHERAL GRIP

(71) Applicant: James Thomas Campana, Petaluma, CA (US)

(72) Inventor: James Thomas Campana, Petaluma, CA (US)

( * ) Notice: Subject to any disclaimer, the term of this patent is extended or adjusted under 35 U.S.C. 154(b) by 77 days.

(21) Appl. No.: 13/831,925

(22) Filed: Mar. 15, 2013

Related U.S. Application Data

(60) Provisional application No. 61/611,583, filed on Mar. 16, 2012.

(51) Int. Cl.
*A63H 33/18* (2006.01)
*A63H 27/00* (2006.01)
*A63B 65/10* (2006.01)

(52) U.S. Cl.
CPC ..... *A63H 27/00* (2013.01)
USPC ..... 446/46; 446/48

(58) Field of Classification Search
USPC ..... 446/46–48, 61; D21/436, 441, 443
See application file for complete search history.

(56) References Cited

U.S. PATENT DOCUMENTS

| | | | | |
|---|---|---|---|---|
| 2,002,631 | A | 5/1935 | Fiondella | |
| 3,026,110 | A | 3/1962 | Hess et al. | |
| 4,031,655 | A | 6/1977 | Ponciano et al. | |
| 4,058,314 | A | 11/1977 | Wolf | |
| 4,112,612 | A * | 9/1978 | Woods | 446/48 |
| 4,132,030 | A * | 1/1979 | Lehman | 446/46 |
| 5,326,299 | A | 7/1994 | Jasinski | |
| 5,476,405 | A | 12/1995 | Clayborne | |
| D374,048 | S | 9/1996 | Lance | |
| D420,056 | S | 2/2000 | Mauldin, Jr. | |
| 6,089,938 | A * | 7/2000 | Spector | 446/46 |
| 6,837,813 | B2 * | 1/2005 | Darnell | 473/590 |
| D704,386 | S * | 5/2014 | Woller et al. | D30/121 |

* cited by examiner

*Primary Examiner* — Kien Nguyen
(74) *Attorney, Agent, or Firm* — Patent Law Offices of Michael E. Woods; Michael E. Woods

(57) ABSTRACT

An aerodynamic circular foundation (i.e., disc or annulus) having a perimeter supporting two or more evenly spaced handgrips. The handgrips improve throwing and catching without appreciably altering aerodynamics.

6 Claims, 5 Drawing Sheets

FLYING AERODYNAMIC TOY WITH PERIPHERAL GRIP

CROSS REFERENCE TO RELATED APPLICATIONS

This application claims benefit of U.S. Patent Application No. 61/611,583 filed 16 Mar. 2013, the contents of which are hereby expressly incorporated by reference thereto in its entirety for all purposes.

FIELD OF THE INVENTION

The present invention relates generally to rotating flying toys, and more specifically, but not exclusively, to enhancements to aerodynamic flying rotating objects which are injection molded in a single molding operation.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

In amusement systems and novelties, one feature that is important to many users is variety in design and playability. For many users, something that is "different" will be determined to be better than other preexisting systems. When differences improve and/or enhance one or more playability factors of existing systems, the user understands the product to be superior in at least some aspects.

Toys such as aerodynamic flying discs and annuli have become common place. They are most often optimized for aerodynamics and improved flight dynamics. For example, a distance that the user may throw the toy, or a time-aloft metric, or flight stability/predictability, are often measurements of the desirability of such toys.

What is needed is a system and method for enhancing a playability feature of an aerodynamic flying disc or flying annulus.

BRIEF SUMMARY OF THE INVENTION

Disclosed is a system and method for enhancing a playability feature of an aerodynamic flying disc or flying annulus. The following summary of the invention is provided to facilitate an understanding of some of the technical features related to playability enhancement of aerodynamic flying discs and annuli, and is not intended to be a full description of the present invention. A full appreciation of the various aspects of the invention can be gained by taking the entire specification, claims, drawings, and abstract as a whole.

Preferred embodiments of the present invention include an aerodynamic circular foundation (i.e., disc or annulus) having a perimeter supporting two or more evenly spaced handgrips. The handgrip improves throwing and catching without appreciably altering aerodynamics. Depending upon specifics, use of the handgrip when throwing can enhance the user's ability to impart desirable rotation to the toy. Some flight characteristics may be improved by increasing an angular momentum of the toy through enhanced rotation and perimeter-attached handgrips. Catching is easier as the handgrips enhance an ability of the user to grip the toy and interrupt the flight.

A flying toy, including a central member configured to generate an aerodynamic lifting force when rotating about a rotational axis and moving perpendicular to the rotational axis, the central member including an outer perimeter and the rotational axis with the rotational axis perpendicular to a plane containing the central member; and a plurality of handgrips evenly distributed around the outer perimeter wherein a portion of each the handgrip extends outside of the outer perimeter.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a system and method for enhancing a playability feature of an aerodynamic flying disc or flying ring. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

An aerodynamic lifting force as used herein refers to a pressure differential resulting from disparate air flow rates over a top surface of an aerodynamic toy and a bottom surface of the toy. Typically a toy requires a non-uniform cross-section in order to generate disparate air flow rates. A ring having a uniform circular cross-section is excluded from the category of aerodynamic toy.

Figure 1:
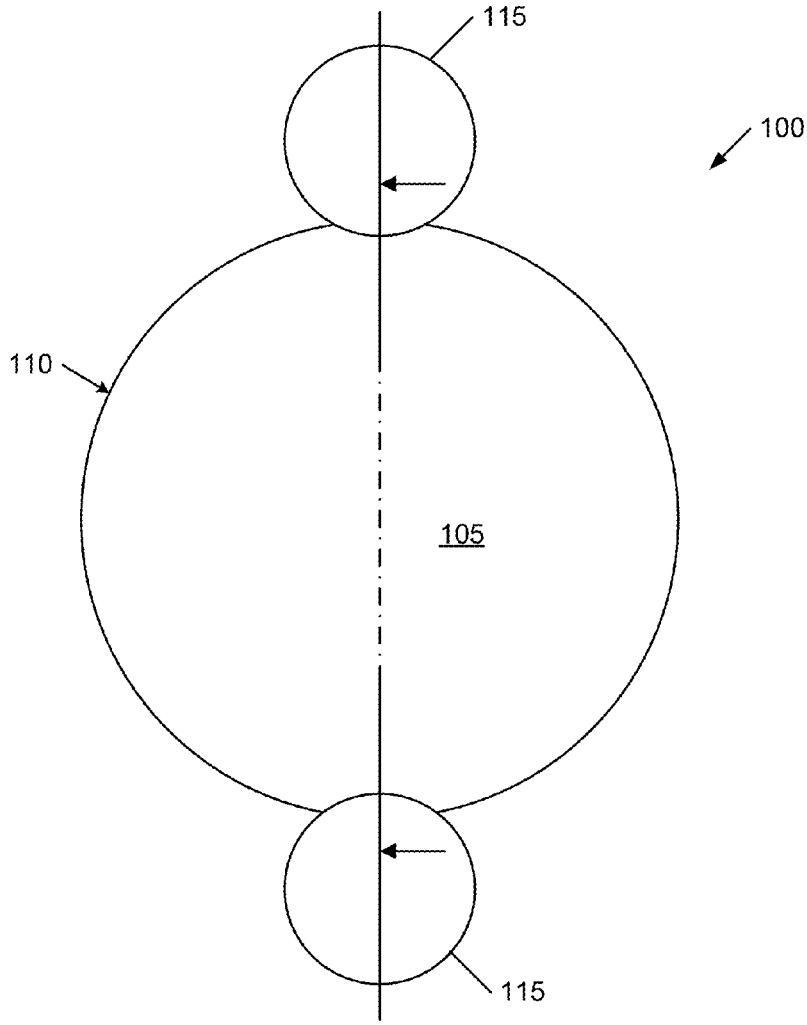
FIG. 1 illustrates a top view of an enhanced aerodynamic flying toy.
Figure 2:
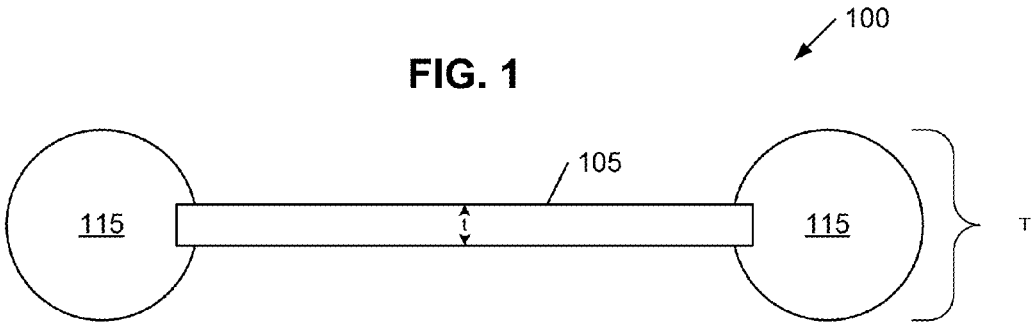
FIG. 2 illustrates a section view of the enhanced aerodynamic flying toy of FIG. 1.

FIG. 1 illustrates a top view of an enhanced aerodynamic flying toy 100 and FIG. 2 illustrates a section view of enhanced aerodynamic flying toy 100. Toy 100 includes an aerodynamic disc 105 that includes a circular perimeter 110 (though in some embodiments the perimeter need not be circular but include a polygon with distributed vertices). Evenly spaced around perimeter 110 are two or more handgrips 115. Evenly spaced in this context refers to a relative angular separation that equals 360/N where N is an integer 2 or greater (N being the number of handgrips 115). Thus for N=2, handgrips 115 are separated by 180 degrees, and for N=3 they are separated by 120 degrees.

Disc 105 is depicted in FIG. 1 as a generic circular structure having a generally rectangular cross-section (FIG. 2) as the specifics of the aerodynamics features of disc 105 are secondary to toy 100 since any disc 105 may be adapted with handgrips 115 as described herein. In the preferred embodiment, disc 105 is constructed as a single piece structure integrally molded from flexible plastic material having a central flight plate section, an outer rim, and a shoulder section connecting the central flight plate section to the outer rim. The specifics of the material, features of the central flight plate section, outer rim, and shoulder are also secondary.

Handgrips 115 are three-dimensional structures having several general properties but otherwise may be variable as to material, construction, attachment, and shape. The general properties include the even spacing around perimeter 110 as previously mentioned. Additionally, the general properties are that each handgrip 115 extends beyond the perimeter (FIG. 1) and has a thickness T greater than a nominal thickness t of disc 105 (FIG. 2). In other respects there is great variability as to other properties that may be employed by toy 100.

While handgrip 115 is shown generally as a sphere, it may have virtually any configuration satisfying the other properties described above as to shape. Handgrip 115 may be soft (e.g., squeezable) or hard, may be lightweight with low density and add no appreciable extra weight to disc 105 or it may be relatively heavy and dense to offer a significant percentage to a majority percentage of the total weight of toy 100. Handgrip 115 may be of independent construction from disc 105 and attached to perimeter 110 after disc 105 is fabricated or handgrip 115 may be integrated with disc 105 and co-formed with disc 105 during fabrication. Just as there are many different arrangements and constructions for disc 105, specifics of attachment/cofabrication of handgrip 115 are adapted as necessary to ensure that handgrip 115 is secured to perimeter 110.

In operation, a user may hold a handgrip 115 and use it to impart rotation to toy 100 as it is thrown and/or the user may catch rotating toy 100 as it moves through the air by grabbing handgrip 115. Rotating toy 100 helps to co-locate one handgrip 115 into the user's grasp during catching. If the user does not initially catch toy 100 by a handgrip 115, the rotation of toy 100 will soon bring a handgrip 115 into the user's hand and allow the user to more easily catch toy 100.

Figure 3:
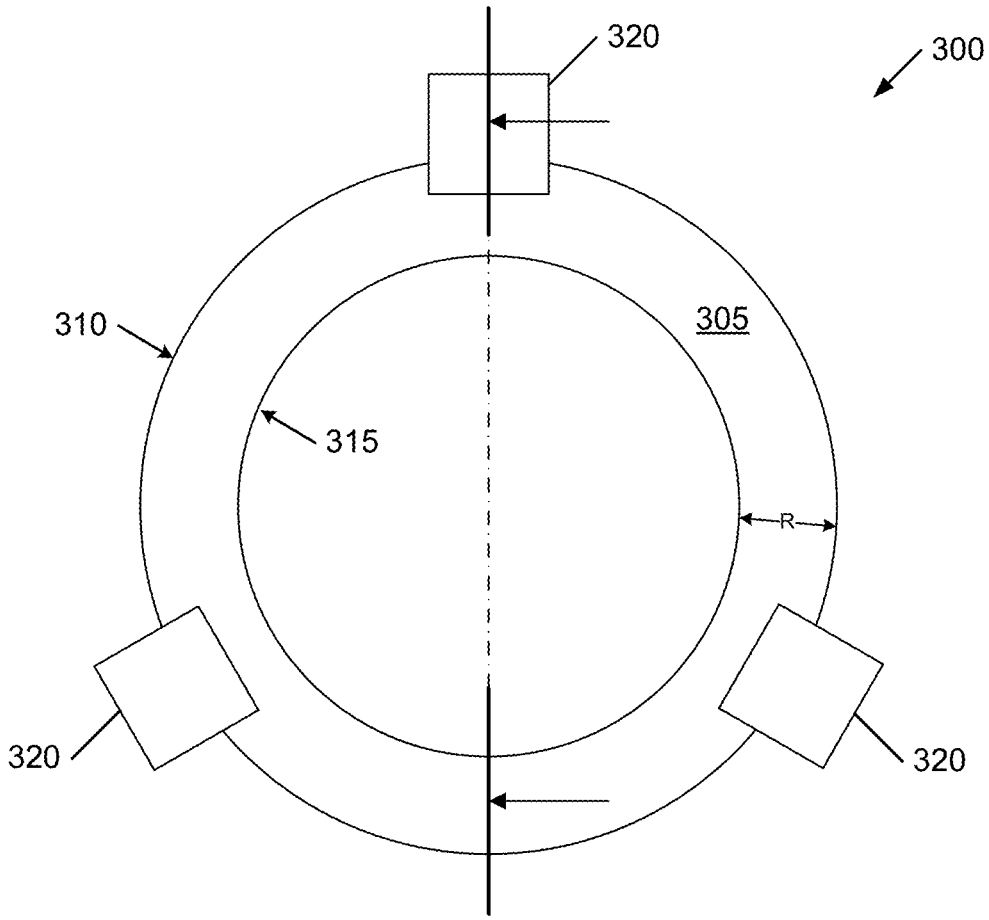
FIG. 3 illustrates a top view of an alternate enhanced aerodynamic flying toy.
Figure 4:
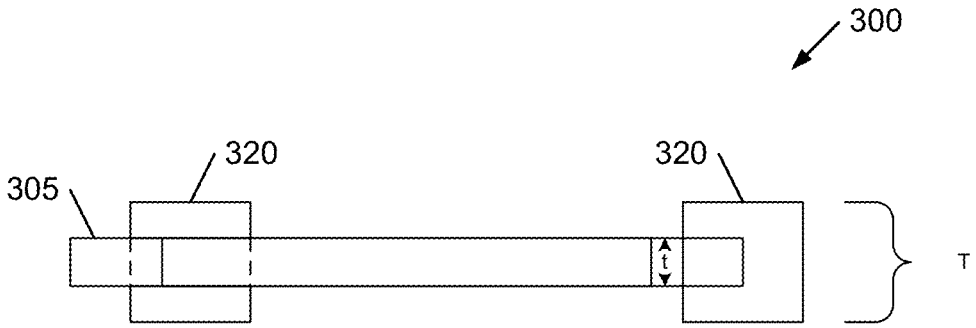
FIG. 4 illustrates a section view of the alternate enhanced aerodynamic flying toy of FIG. 3.

FIG. 3 illustrates a top view of an alternate enhanced aerodynamic flying toy 300 and FIG. 4 illustrates a section view of the alternate enhanced aerodynamic flying toy 300. Toy 300 includes an aerodynamic annulus 305 that includes an outer circular perimeter 310 and inner circular perimeter 315 separated by a distance R (which is the difference of the radii of between perimeter 310 and perimeter 315). However in some embodiments the outer perimeter and/or the inner perimeter need not be circular. Evenly spaced around perimeter 310 are two or more handgrips 320. Evenly spaced in this context refers to a relative angular separation that equals 360/N where N is an integer 2 or greater (N being the number of handgrips 115). Thus for N=2, handgrips 115 are separated by 180 degrees, and for N=3 they are separated by 120 degrees.

Annulus 305 is depicted in FIG. 3 as a generic annulus structure having a generally rectangular cross-section (FIG. 4) with an inner disc area removed. The specifics of the aerodynamics features of annulus 305 are secondary to toy 300 since any annulus 305 may be adapted with handgrips 320 as described herein. In the preferred embodiment, annulus 305 is constructed as a single piece structure integrally molded from flexible plastic material having a central flight annular plate section with an attached outer rim. The specifics of the material, features of the central flight annular plate section and outer rim are also secondary.

Handgrips 320 are three-dimensional structures having several general properties but otherwise may be variable as to material, construction, attachment, and shape. The general properties include the even spacing around perimeter 310 as previously mentioned. Additionally, the general properties are that each handgrip 320 extends beyond the perimeter (FIG. 3) and has a thickness T greater than a nominal thickness t of annulus 305 (FIG. 4). In other respects there is great variability as to other properties that may be employed by toy 300. For example, handgrip 320 is shown extending outside toy 300 (i.e., beyond perimeter 310). In some embodiments, handgrip 320 may extend inside toy 300 (i.e., beyond perimeter 315 towards the center) in addition to, or instead of, extending outside toy 300.

While handgrip 320 is shown generally as a cube, it may have virtually any configuration satisfying the other properties described above as to shape. Handgrip 320 may be soft (e.g., squeezable) or hard, may be lightweight with low density and add no appreciable extra weight to annulus 305 or it may be relatively heavy and dense to offer anywhere from a significant percentage to a majority percentage of the total weight of toy 300. Handgrip 320 may be of independent construction from annulus 305 and attached to perimeter 310 after annulus 305 is fabricated or handgrip 320 may be integrated with annulus 305 and co-formed with annulus 305 during fabrication. Just as there are many different arrangements and constructions for annulus 305, specifics of attachment/cofabrication of handgrip 320 is adapted as necessary to ensure that handgrip 320 is secured to perimeter 310.

In operation, a user may hold one of handgrips 320 and use it to impart rotation to toy 300 as it is thrown and/or the user may catch rotating toy 300 as it moves through the air by grabbing handgrip 320. Rotating toy 300 helps to co-locate one handgrip 320 into the user's grasp during catching. If the user does not initially catch toy 300 by a handgrip 320, the rotation of toy 300 will soon bring a handgrip 320 into the user's hand and allow the user to more easily catch toy 300.

Handgrip attachment may be varied not only in the type of attachment mechanism, but there are advantages in different handgrip overlap with the central body member. For example, FIG. 1 and FIG. 2 illustrate an embodiment with minimal overlap while FIG. 3 and FIG. 4 illustrate an embodiment with a greater degree of overlap. These are but representative and other ranges are possible within the scope of the present invention. Not only radial overlap, but in FIG. 2, there may be advantages to having the handgrips out of a plane of the central member (shown as coplanar). In some embodiments, while rotational balance is preferred (circular central body with evenly spaced and radially-equidistant handgrips), some embodiments may provide visual imbalance while preserving functional balance. For example, handgrips may include different shapes and locations as long as, collectively, the desired degree of rotational balance is maintained (such as, for example by having different densities or centers-of-gravity for the different handgrips).

Figure 5:
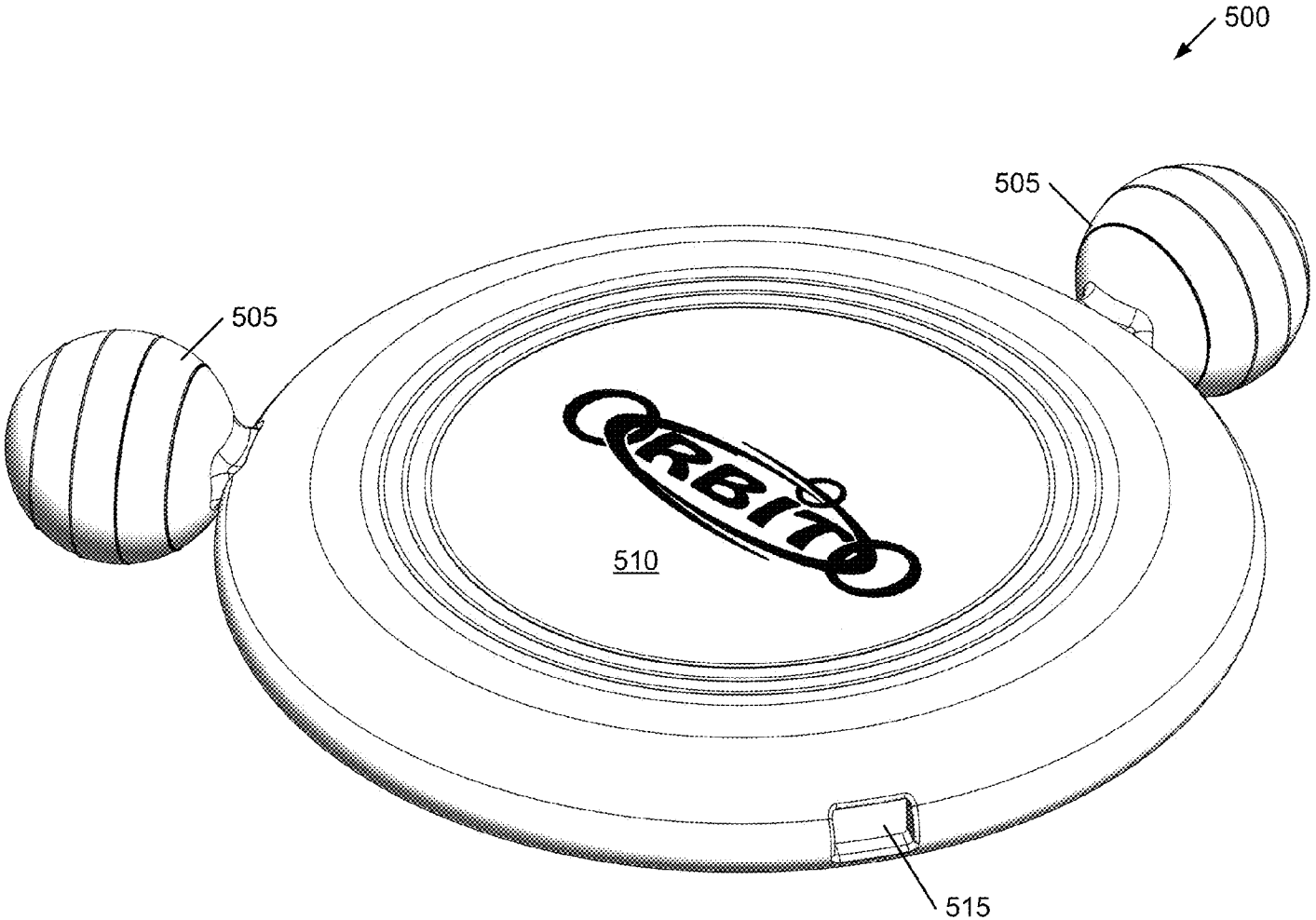
FIG. 5 illustrates an isometric view of a second alternate enhanced aerodynamic flying toy.
Figure 6:
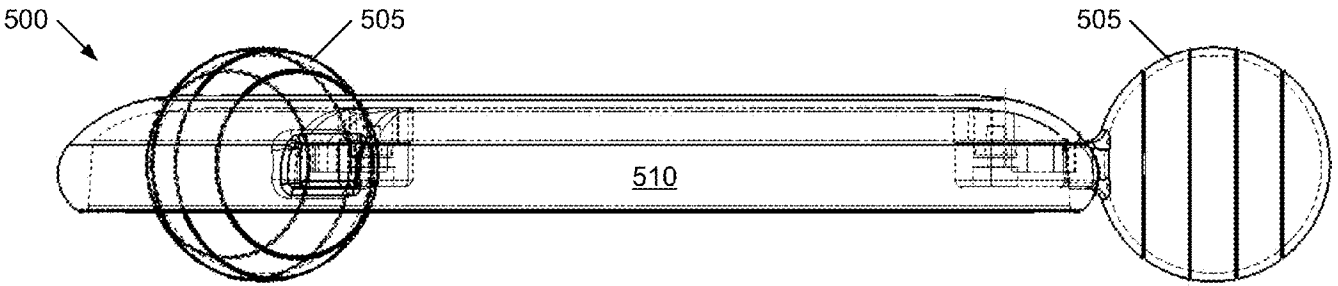
FIG. 6 illustrates a side view of the second alternate enhanced aerodynamic flying toy.
Figure 8:
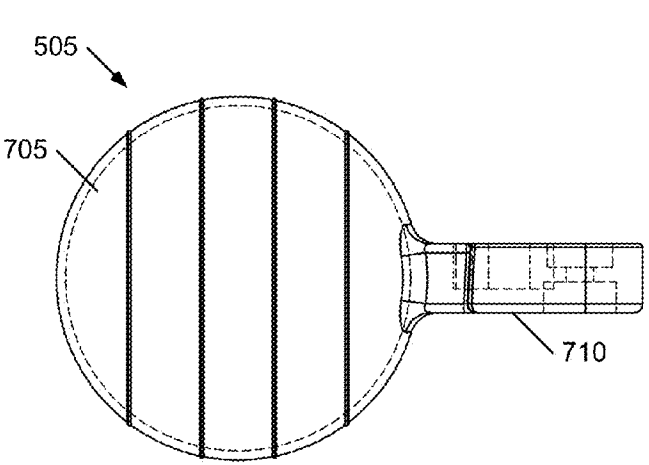
FIG. 8 illustrates a side view of a handgrip used with the second alternate enhanced aerodynamic flying toy.
Figure 7:
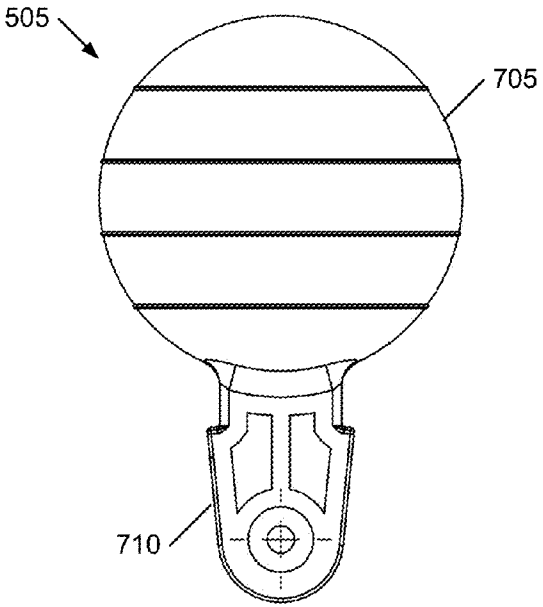
FIG. 7 illustrates a bottom view of a handgrip used with the second alternate enhanced aerodynamic flying toy.
Figure 9:
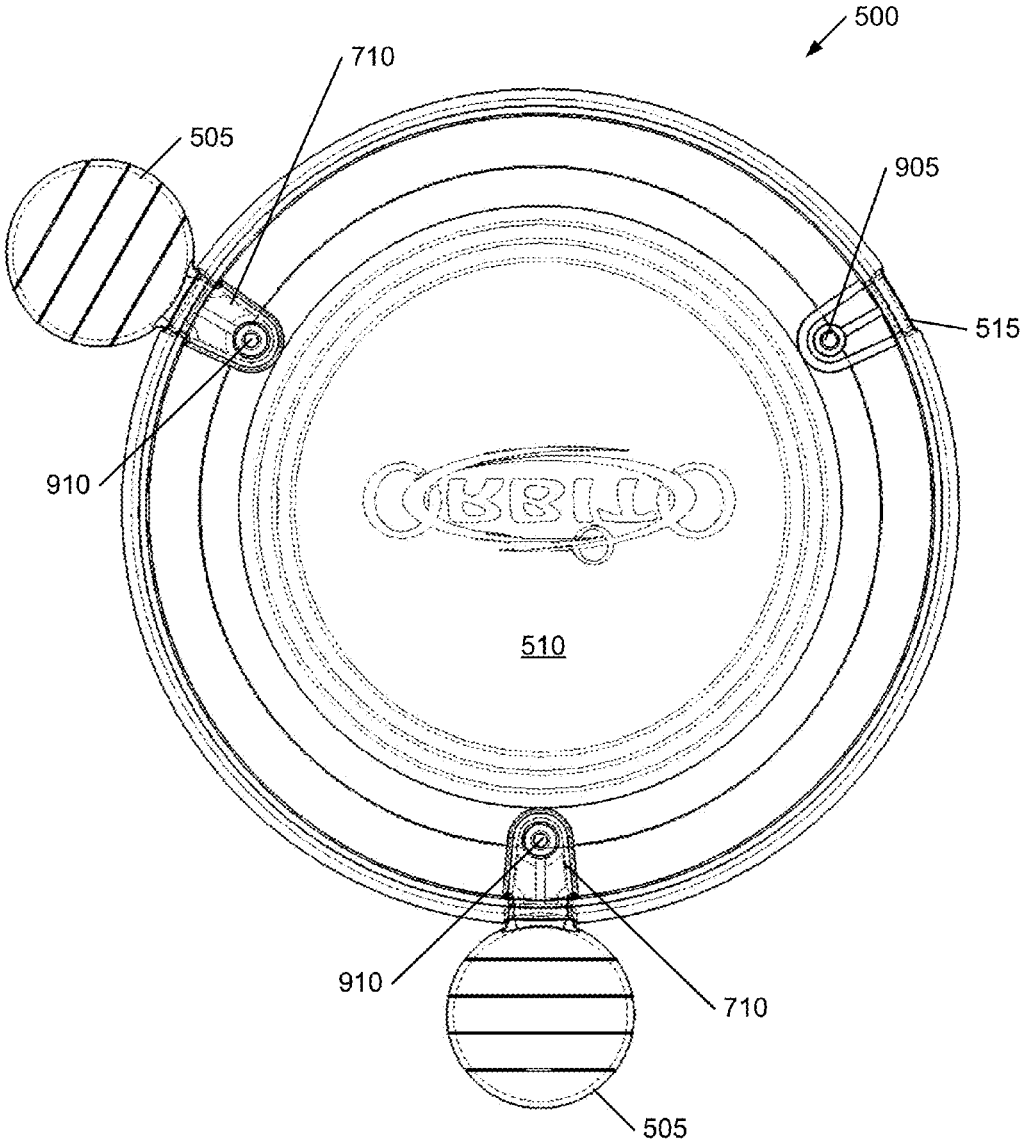
FIG. 9 illustrates a bottom view of the second alternate enhanced aerodynamic flying toy.

FIG. 5 illustrates an isometric view of a second alternate enhanced aerodynamic flying toy 500 including a number N (e.g., N=3) of handgrips 505, and FIG. 6 illustrates a side view of second alternate enhanced aerodynamic flying toy 500. FIG. 7 illustrates a bottom view of one of the N number of handgrips 505 used with second alternate enhanced aerodynamic flying toy 500 and FIG. 8 illustrates a side view of one of the N number of handgrips 505 used with second alternate enhanced aerodynamic flying toy 500. FIG. 9 illustrates a bottom view of second alternate enhanced aerodynamic flying toy 500.

Toy 500 includes an aerodynamic disc 510 that includes a circular perimeter (though in some embodiments the perimeter need not be circular but include a polygon with distributed vertices). Evenly spaced around the perimeter are the N number of handgrips 505. Evenly spaced in this context refers to a relative angular separation that equals 360/N where N is an integer 2 or greater. Thus for N=2, handgrips 505 are separated by 180 degrees, and for N=3 they are separated by 120 degrees. Toy 500 includes three handgrips 505, one is shown removed to illustrate a handgrip attachment mechanism 515. In some implementations, there may be many attachment mechanisms 515 distributed around the perimeter of disk 510, a greater number than handgrips 505. A user is able to determine a number of handgrips 505 to attach and a desired attachment pattern by selecting a subset of the available attachment mechanisms 515.

Disc 510 is illustrated as a generic circular structure. As shown, disc 510 is constructed as a single piece structure integrally molded from flexible plastic material having a central flight plate section, an outer rim, and a shoulder section connecting the central flight plate section to the outer rim.

Handgrips 505 are three-dimensional assembly structures including an exterior grip portion 705 and a clip portion 710. Exterior grip portion 705 is the human interface component and clip portion 710 is the disc-engagement component. Handgrip attachment mechanism 515 includes a female socket defined in an exterior of the perimeter of disc 510. Clip portion 705 is a male connector complementary to the female socket. The male connector is squeezed and inserted into the female socket which then mechanically locks it into place. In this configuration, exterior grip portion 705 is completely outside the perimeter of disk 510.

Exterior grip portions 705 have several general properties but otherwise may be variable as to material, construction, attachment, and shape. The general properties include the even spacing around the perimeter as previously mentioned. Additionally, the general properties are that each handgrip 505 extends beyond the perimeter of disc 510 and has a diameter greater than a nominal thickness of disc 510. In other respects there is great variability as to other properties that may be employed by toy 500.

While handgrip 505 is shown generally as a sphere, it may have virtually any configuration satisfying the other properties described above as to shape. Handgrip 505 may be soft (e.g., squeezable) or hard, may be lightweight with low density and add no appreciable extra weight to disc 510 or it may be relatively heavy and dense to offer a significant percentage to a majority percentage of the total weight of toy 500. Just as there are many different arrangements and constructions for disc 510, specifics of attachment/cofabrication of handgrip 505 are adapted as necessary to ensure that handgrip 505 is secured to the perimeter. One way to help ensure that handgrip 505 is secured to disk 510, in addition to the engagement of the male and female elements, is to use a screw inset 905 with each attachment mechanism. Then a screw 910 secures clip portion 710 within attachment mechanism further inhibiting detachment of handgrip 505 from disk 510. As handgrip 505 is designed to be used to launch and catch toy 500, and handgrip 505 will often make contact with other objects during flight, extra effort to secure handgrip 505 to disc 510 is advantageous and preferred.

In operation, a user may hold handgrip 505 and use it to impart rotation to toy 500 as it is thrown and/or the user may catch rotating toy 500 as it moves through the air by grabbing handgrip 505. Rotating toy 500 helps to co-locate one handgrip 505 into the user's grasp during catching. If the user does not initially catch toy 500 by any particular handgrip 505, the rotation of toy 500 will soon bring another handgrip 505 into the user's hand and allow the user to more easily catch toy 500.

The system and methods above has been described in general terms as an aid to understanding details of preferred embodiments of the present invention. In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A flying toy, comprising:

a rigid central member configured to generate an aerodynamic lifting force when rotating about a rotational axis and moving perpendicular to said rotational axis, said central member including an outer perimeter and said rotational axis with said rotational axis perpendicular to a plane containing said central member; and a plurality of handgrips evenly distributed around said outer perimeter wherein a portion of each said handgrip extends beyond said outer perimeter, extends above a top surface of said central member, and extends below a bottom-most portion of said central member; wherein each said handgrip is a spheroid having a central plane aligned with said plane containing said central member.

2. The flying toy of claim 1 wherein each said handgrip is soft having a pliable exterior surface configured to inelastically deform in response to a compressive load.

3. The flying toy of claim 1 wherein each said handgrip is hard having a rigid exterior surface configured to resist deformation in response to a compressive load.

4. The flying toy of claim 1 wherein each said spheroid includes a radius extending from a spheroid center of mass along said central plane and wherein an overlap region between said spheroid and said central member is less than 25% of said radius.

5. The flying toy of claim 1 wherein said central member includes a circular annulus having a circular outer perimeter.

6. A flying toy, comprising:

a rigid central member configured to generate an aerodynamic lifting force when rotating about a rotational axis and moving perpendicular to said rotational axis, said central member including an outer perimeter and said rotational axis with said rotational axis perpendicular to a plane containing said central member; and a plurality of handgrips evenly distributed around said outer perimeter wherein a portion of each said handgrip extends beyond said outer perimeter, extends above a top surface of said central member, and extends below a bottom-most portion of said central member;

wherein said central member includes a circular disk having a circular outer perimeter; and wherein each said handgrip is a spheroid having a central plane aligned with said plane containing said central member.

* * * * *